US005937462A

United States Patent [19]

Huang

[11] Patent Number: 5,937,462

[45] Date of Patent: Aug. 17, 1999

[54] SELF-INFLATABLE AIR CUSHION

[76] Inventor: Ing Chung Huang, No. 218 Cheng Kung Three Road, Nantou, Taiwan

[21] Appl. No.: 08/876,494

[22] Filed: Jun. 16, 1997

[30] Foreign Application Priority Data

Jun. 17, 1996 [TW] Taiwan ..... 85107315

[51] Int. Cl.[6] ..... A47C 27/08; A43B 13/20

[52] U.S. Cl. ..... 5/655.3; 5/654; 36/29; 36/35 B

[58] Field of Search ..... 5/655.3, 655.5, 5/708, 654; 36/29, 71, 35 R, 35 B, 3 B

[56] References Cited

U.S. PATENT DOCUMENTS

| | | | |
|---|---|---|---|
| 3,583,008 | 6/1971 | Edwards | 5/708 X |
| 4,446,634 | 5/1984 | Johnson et al. | 36/29 |
| 4,763,426 | 8/1988 | Polus et al. | 36/35 B X |
| 5,195,254 | 3/1993 | Tyng | 36/29 X |
| 5,222,312 | 6/1993 | Doyle | 36/29 X |
| 5,335,382 | 8/1994 | Huang | 5/655.3 |
| 5,406,661 | 4/1995 | Pekar | 5/655.3 |
| 5,558,395 | 9/1996 | Huang | 5/655.3 X |
| 5,794,361 | 8/1998 | Sadler | 36/29 |

FOREIGN PATENT DOCUMENTS

| | | | |
|---|---|---|---|
| 33544 | 12/1989 | Taiwan . | |
| 2206475 | 1/1989 | United Kingdom | 36/29 |

*Primary Examiner*—Brian K. Green
*Assistant Examiner*—Robert G. Santos
*Attorney, Agent, or Firm*—Bacon & Thomas, PLLC

[57] ABSTRACT

A self-inflatable air cushion which includes a support chamber mounted in a sole of a shoe and holding a fluid, a collapsible plenum chamber surrounded by the support chamber and partially protruding over the top of the sole and having a top air hole, passage means connected between the support chamber and the plenum chamber, and one-way valve mounted in the passage means to let air flow move in one direction from the plenum chamber to the support chamber upon compression of the plenum chamber.

8 Claims, 5 Drawing Sheets

SELF-INFLATABLE AIR CUSHION

BACKGROUND OF THE INVENTION

The present invention relates to a self-inflatable air cushion for use in shoes, and more particularly to such a self-inflatable air cushion which comprises a collapsible plenum chamber, a support chamber, and an one-way valve connected between the plenum chamber and the support chamber for permitting air to be driven from the collapsible plenum into the support chamber by compressing the plenum chamber with the foot.

A regular air cushion for shoes is generally comprised of a collapsible three-dimensional body defining a plurality of air cells and a plurality of passages connected between the air cells, and an air valve connected to the passages and disposed outside the sole of the shoe. When the air cushion is inflated, an air pump is attached to the air valve and operated to pump air into the air cells. If the inside pressure of the air cushion is excessively high, it cannot be regulated.

SUMMARY OF THE INVENTION

According to one aspect of the present invention, the self-inflatable air cushion comprises a support chamber, a collapsible plenum chamber surrounded by the support chamber and having an air hole, an air passage communicating between the support chamber and the collapsible plenum chamber, a one-way valve mounted in the air passage which permits air to pass from the plenum chamber to the support chamber. When the plenum chamber is compressed by the foot, air is forced out of the plenum chamber through the one-way valve into the support chamber. When the plenum chamber is released, outside air is drawn into the plenum chamber through its air hole. According to another aspect of the present invention, a relief valve or pressure regulating chamber is provided to regulate the inside pressure of the support chamber to the desired level. According to still another aspect of the present invention, a pressure accumulation chamber is provided having one end connected to the plenum chamber through a one-way valve, which permits air to flow from the plenum chamber to the pressure accumulation chamber, and an opposite end connected to the support chamber through a one-way valve, which permits air to flow from the pressure accumulation chamber to the support chamber. When the plenum chamber is compressed, air pressure is driven from the plenum chamber into the pressure accumulation chamber. However, because the support chamber simultaneously receives an external pressure, the air pressure of the pressure accumulation chamber is prevented from passing to the support chamber. When the external pressure is released from the support chamber, the air pressure of the pressure accumulation chamber is allowed to pass to the inside of the support chamber.

DETAILED DESCRIPTION OF THE PREFERRED EMBODIMENTS

Figure 1:
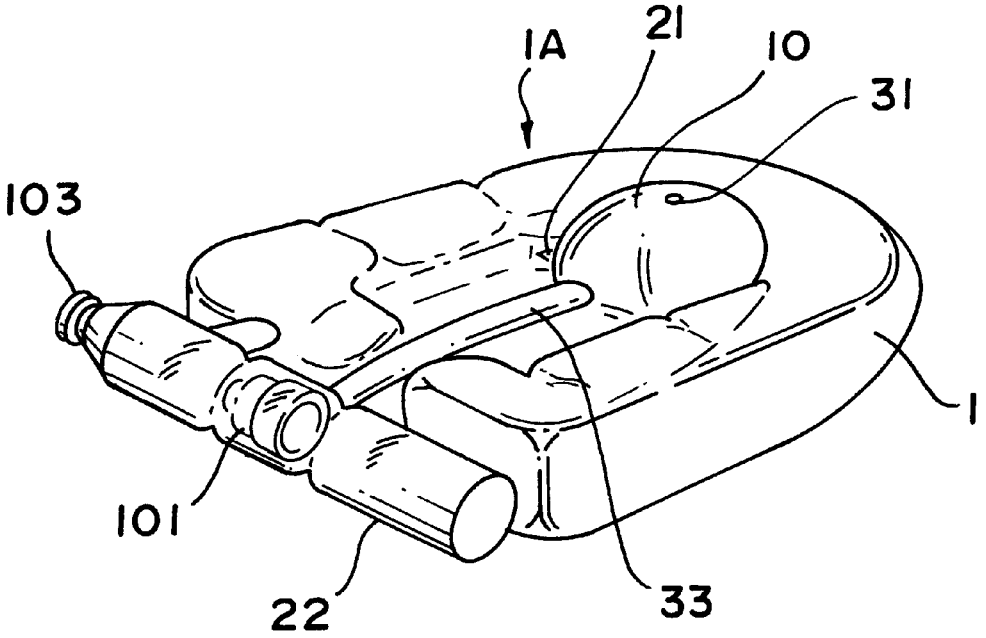
FIG. 1 is a perspective view of a self-inflatable air cushion according to one embodiment of the present invention.

Referring to FIG. 1, a self-inflatable air cushion 1*a* is shown comprising a support or air chamber 1, an open space 21 surrounded by the air chamber 1, a plenum chamber 10 disposed in the open space 21 and having an air hole 31, an air cylinder 22 having its one end, namely, the rear end disposed in communication with the support chamber 1, a connecting tube 33 connected between the plenum chamber 10 and the air cylinder 22, an one-way valve 101 mounted in the air cylinder 22 which permits air to pass from the plenum chamber 10 through the air cylinder 22 to the inside of the support chamber 1, and a relief valve 103 mounted in one end, namely, the front end of the air cylinder 22.

Figure 2:
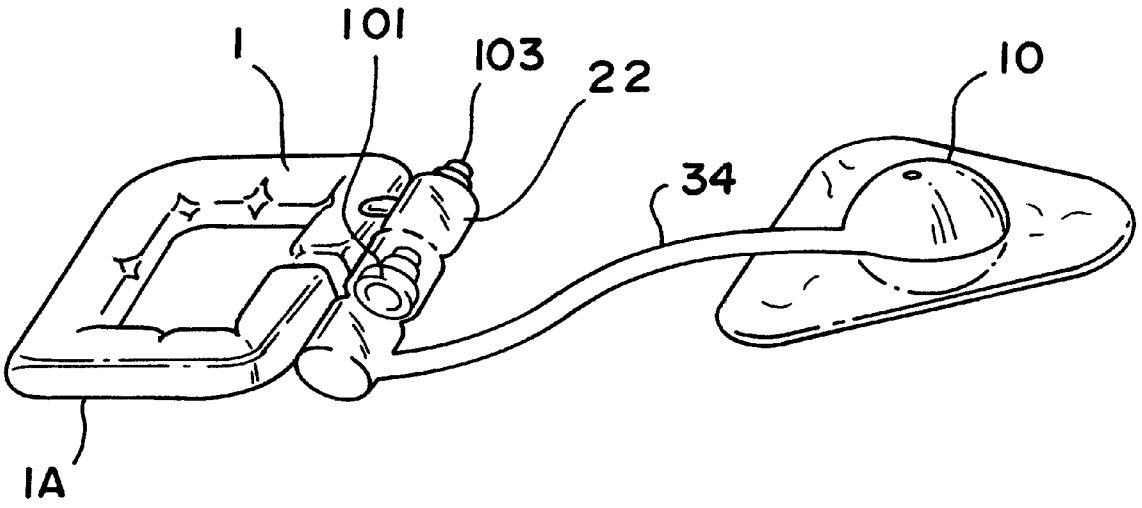
FIG. 2 is a perspective view of a self-inflatable air cushion according to an alternate form of the present invention.

FIG. 2 shows an alternate form of the present invention. According to this alternate form, the air cushion 1*b* comprises a support chamber 1, an air cylinder 22 connected to the support chamber 1 at one side, a plenum chamber 10 spaced from the air cylinder 22 at one side opposite to the support chamber 1, and a connecting tube 34 connected between one end, namely, the rear end of the air cylinder 22 and the polonium chamber 10, an one-way valve 101 mounted in the air cylinder 22 for permitting air to be delivered from the plenum chamber 10 to the support chamber 1, and a relief valve 103 mounted in one end, namely, the front end of the air cylinder 22.

Figure 3:
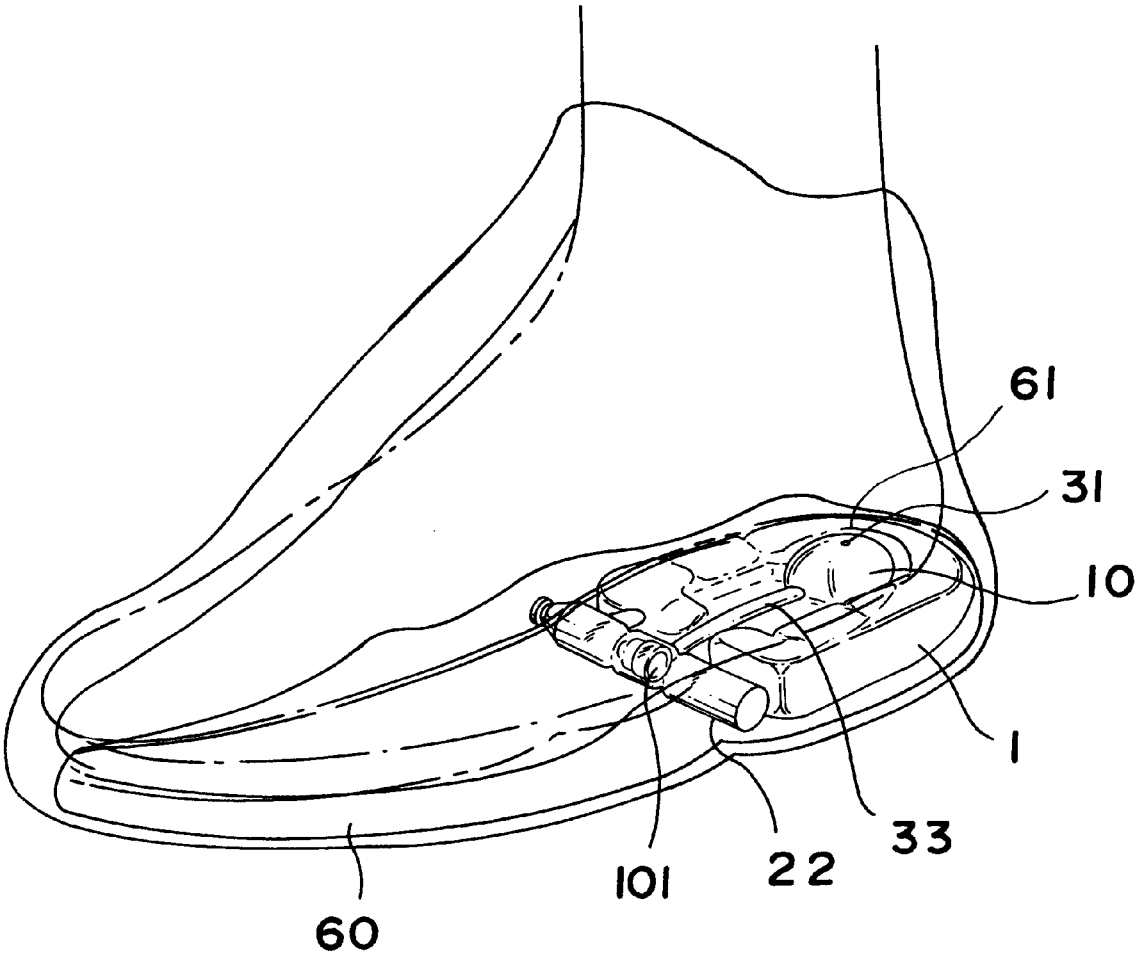
FIG. 3 is an applied view of the present invention, showing the self-inflatable air cushion mounted in an insole of a shoe and operated by the foot of the wearer.

Referring to FIG. 3, the air cushion 1A is mounted inside an insole 6 of a shoe with the plenum chamber 10 projecting out of a top hole 61 of the insole 60 at the heel area. When the user's foot is stepped on the plenum chamber 10, the plenum chamber 10 is collapsed, and the air inside the plenum chamber 10 is forced through the connecting tube 33 and the air cylinder 22 into the support chamber 1. When the user's foot is lifted from the collapsed plenum chamber 10, outside air is immediately drawn into the plenum chamber 10 due to an air pressure difference between the inside pressure of the plenum chamber 10 and the atmospheric pressure. When the user continuously steps on the plenum chamber 1 of the air cushion 1A, the support chamber 1 will become fully inflated. When the support chamber 1 is fully inflated, the support chamber 1 supports the plenum chamber 10 against outside pressure. Further, through the relief valve 103, the user can adjust the pressure of the support chamber 1 to the desired level.

Figure 4:
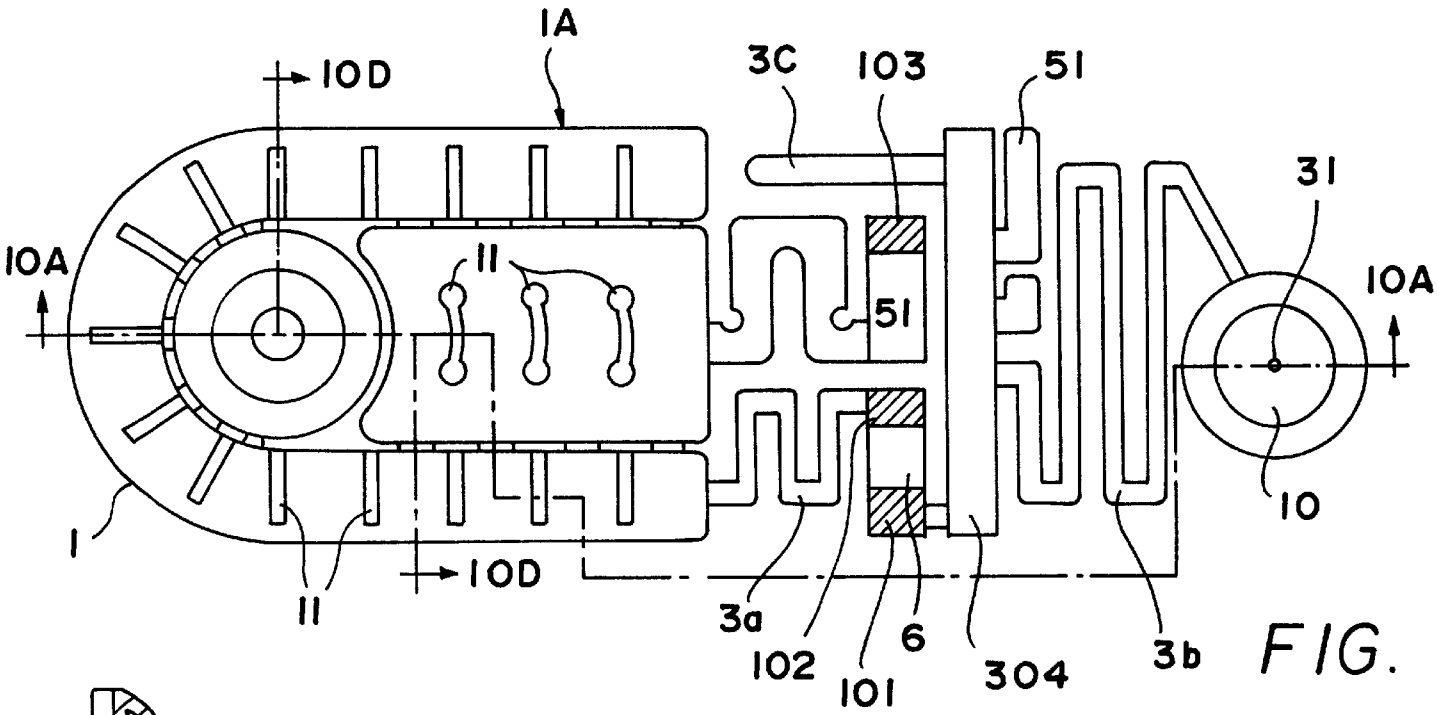
FIG. 4 is a plan view showing another alternate form of the present invention.
Figure 4A:
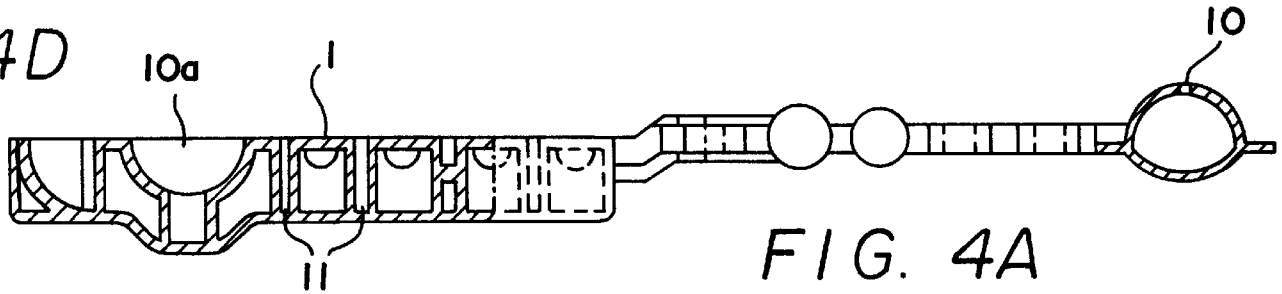
FIG. 4A is a sectional view taken along line 10A—10A of FIG. 4.

Referring to FIG. 4, outside air passes from the air hole 31 into the plenum chamber 10. When the user's foot gives a pressure to the plenum chamber 10, the air hole 31 is stopped by the user's foot and the inside air of the plenum chamber 10 is forced by the pressure of the user's foot to flow through an air passage 3*b* to a pressure regulating chamber 304 and then through the aforesaid one-way valve 101 to a pressure accumulation chamber 6. The pressure accumulation chamber 6 is arranged at a place in which the pressure accumulation chamber 6 bears no pressure when the support chamber 1 or the plenum chamber 10 receives a pressure from the user's foot. Therefore, compressed air is allowed to be forced out of the plenum chamber 10 into the pressure accumulation chamber 6 and then through an one-way valve 102 into the support chamber 1 via an air passage 3*a*.

Figure 4D:
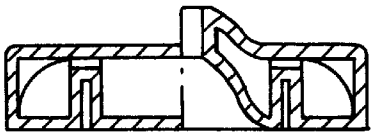
FIG. 4D is a sectional view taken along line 10D—10D of FIG. 4.
Figure 4B:
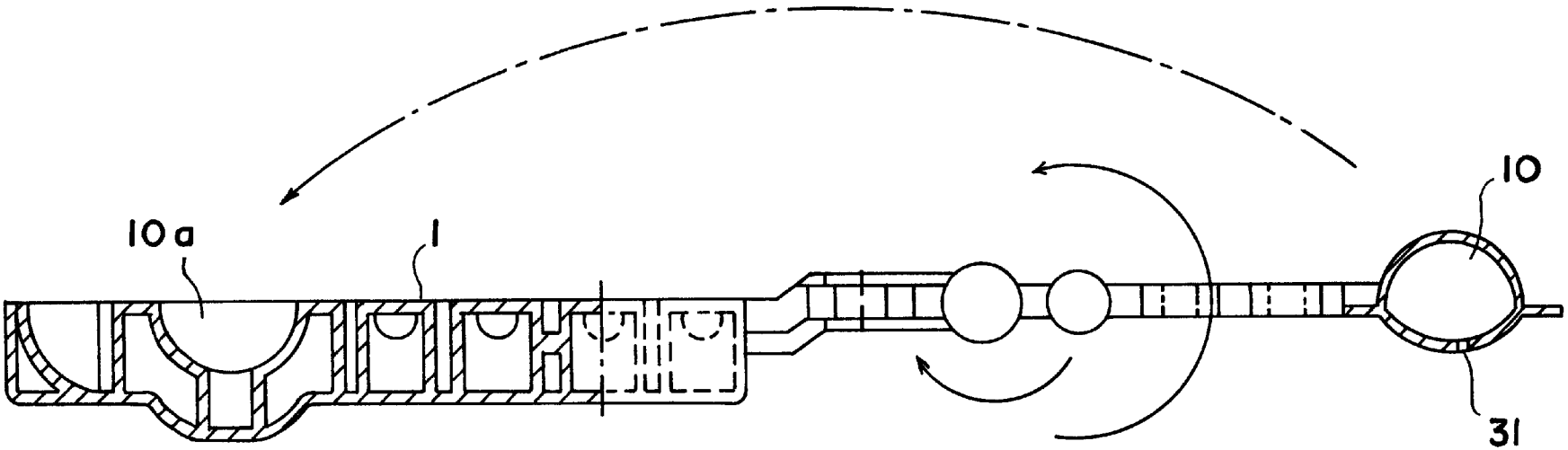
FIG. 4B shows the turning direction of the plenum chamber of the embodiment shown in FIG. 4.
Figure 4C:
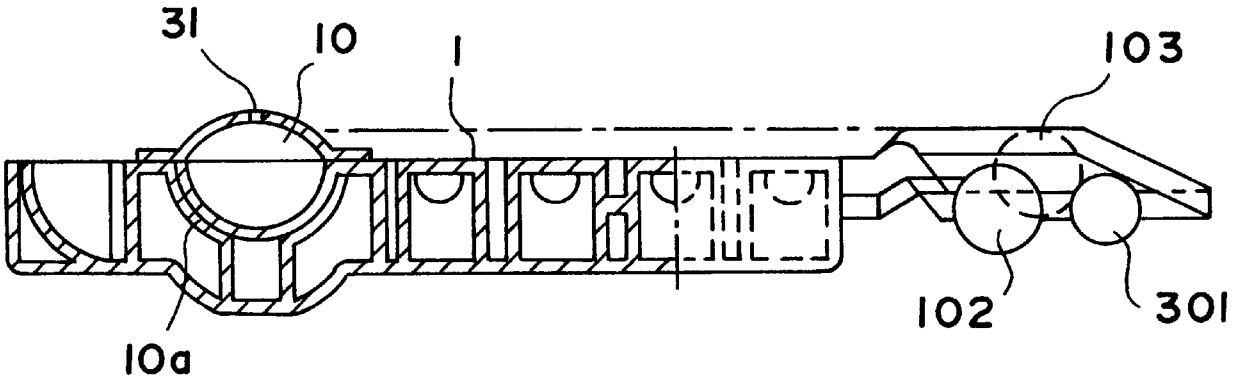
FIG. 4C shows the plenum chamber of the embodiment of FIG. 4 arranged in the top recess of the corresponding support chamber.

Referring to FIGS. 4B, 4C and 4D, the plenum chamber 10 can be turned backwards through about 180° and in a top recess 10*a* of the support chamber 1 with its air hole 31 facing upwards.

Figure 5:
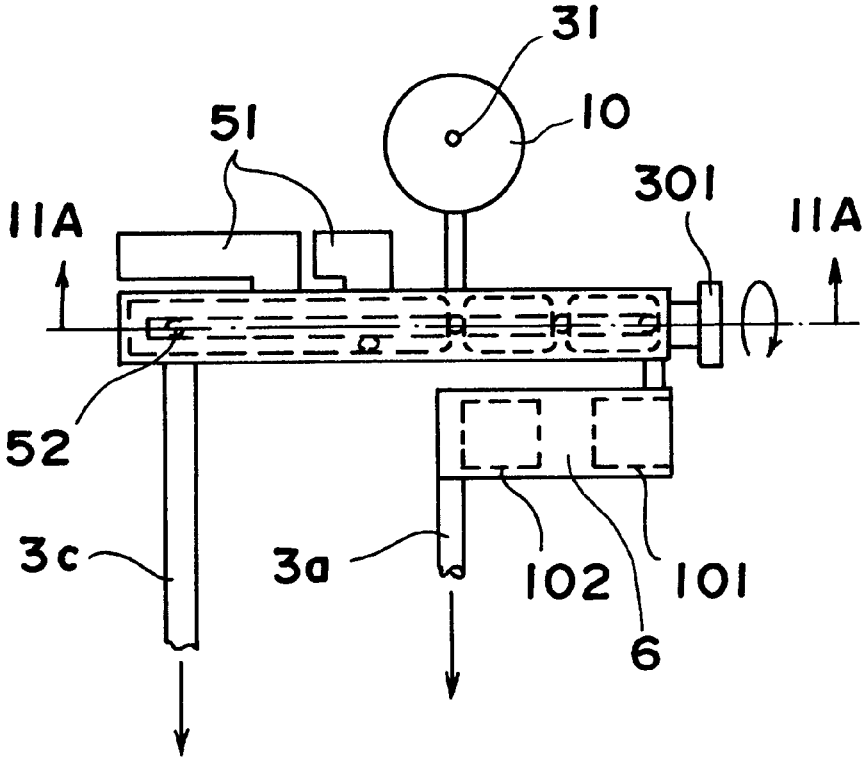
FIG. 5 is a sectional view of still another alternate form of the present invention, showing the installation of the pressure regulating rod in the pressure regulating chamber.
Figure 5A:
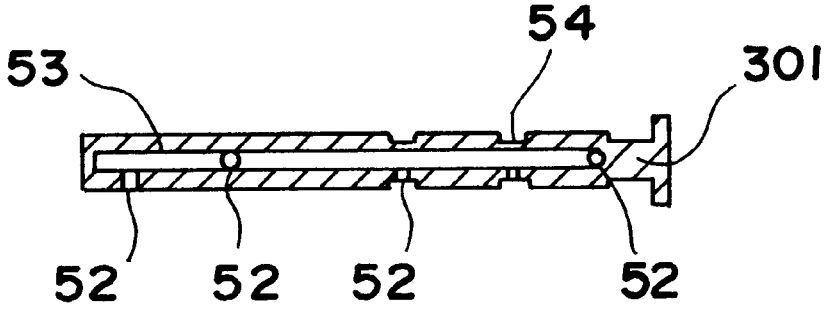
FIG. 5A is a sectional view taken along line 11A—11A, but showing only the regulating rod.

Referring to FIGS. 5 and 5A, a pressure regulating rod 304 is mounted in a pressure regulating chamber 301. The pressure regulating rod 301 is a hollow rod having a longitudinal center hole 53, a plurality of recessed holes 54, and a plurality of radial through holes 52 in communication with the longitudinal center hole 53. The recessed holes 54 and the through holes 52 are arranged corresponding to a plurality of distribution chambers 51, the one-way valve 101, and an air passage 3*a*. By turning the pressure regulating rod 301, the pressure of the pressure accumulation chamber 6 and the support chamber 1 is regulated. When the through holes 52 are moved away from the air passage 3*a,* compressed air cannot pass from the plenum chamber 10 to the support chamber 1. When the air passage 3*a,* the through holes 52 and the distribution chambers 51 are set into communication with one another through the longitudinal center hole 53, air pressure is allowed to pass into the pressure accumulation chamber 6 subject to the volume of the distribution chambers 51. Assume the inside volume of the plenum chamber 10=A, the inside volumes of the distribution chambers 51=B, the inside volume of the plenum chamber 10 when collapsed=C, thus P1V1*P2V2=n, the pressure of the plenum chamber 10 after being compressed is Pb=PaA/B+C, therefore the greater the inside volumes of the distribution chambers 51, the smaller the air pressure Pb in the pressure accumulation chamber 6.

When the through holes 52 and the plenum chamber 10 are disposed in communication with an air passage 3*c,* air is allowed to be squeezed out of the plenum chamber 10 through the air passage 3*c* to another air circulation area. Therefore, the air cushion 1A can also improve the ventilation of the shoe.

It is to be understood that the foregoing detailed description and for purposes of illustration only, and are not intended to limit the scope of the invention disclosed.

What the invention claimed is:

1. A self-inflatable air cushion comprising:

a support chamber having a three-dimensional body adapted for holding a fluid and a top recess at said three-dimensional body for receiving a plenum chamber;

a hollow collapsible plenum chamber having a variable volume which is changed when said plenum chamber is collapsed;

passage means connected between said support chamber and said plenum chamber; and at least one pressure accumulation chamber connected between said plenum chamber and said support chamber by said passage means, said pressure accumulation chamber having an inlet connected to a first one-way valve means mounted in said passage means and an outlet connected to a second one-way valve means mounted in said passage means, said plenum chamber communicating with said pressure accumulation chamber by fluid flow directly from said plenum chamber and moving through said passage means via said first one-way valve means so that reverse flow is prevented from said pressure accumulation chamber to said plenum chamber.

2. The self-inflatable air cushion of claim 1 further comprising a pressure regulating chamber connected between said plenum chamber and said at least one pressure accumulation chamber and controlled to regulate the inside pressure of said support chamber.

3. The self-inflatable air cushion of claim 2, wherein said pressure regulating chamber comprises a pressure regulating rod controlled to regulate the inside pressure of said support chamber.

4. The self-inflatable sir cushion of claim 2, wherein said pressure regulating chamber is connected to at least one air distribution chamber.

5. The self-inflatable air cushion of claim 1, wherein said plenum chamber has an air hole, the air hole for cooperating with a pressure-applying surface to thereby function as an air inlet valve.

6. The self-inflatable air cushion of claim 1, wherein said plenum chamber is mounted in an open space surrounded by said support chamber.

7. The self-inflatable air cushion of claim 1, wherein said plenum chamber is disposed outside said support chamber and spaced from it at a distance by said passage means.

8. The self-inflatable air cushion of claim 1, wherein said plenum chamber comprises at least one one-way valve through which outside air is drawn into said plenum chamber.

* * * * *